US008342348B2

(12) United States Patent
Lin

(10) Patent No.: US 8,342,348 B2
(45) Date of Patent: Jan. 1, 2013

(54) STORAGE BOX

(76) Inventor: Chen-Hsiung Lin, Chiayi Hsien (TW)

( * ) Notice: Subject to any disclaimer, the term of this patent is extended or adjusted under 35 U.S.C. 154(b) by 349 days.

(21) Appl. No.: 12/716,338

(22) Filed: Mar. 3, 2010

(65) Prior Publication Data

US 2011/0215095 A1 Sep. 8, 2011

(51) Int. Cl.
*B65D 25/00* (2006.01)

(52) U.S. Cl. ..... 220/9.4; 220/9.1; 383/119

(58) Field of Classification Search ..... 220/9.1, 220/9.4, 647, 668; 190/126, 127; 383/119, 383/121.1

See application file for complete search history.

(56) References Cited

U.S. PATENT DOCUMENTS 615,720 A * 12/1898 Lane ..... 220/9.1
904,142 A * 11/1908 Moore ..... 220/9.1
1,652,387 A * 12/1927 Barber ..... 43/55
2,517,757 A * 8/1950 Adlerstein ..... 312/3
6,048,099 A * 4/2000 Muffett et al. ..... 383/20
7,392,888 B2 * 7/2008 Lai ..... 190/126
7,861,880 B2 * 1/2011 Britt et al. ..... 220/9.2
8,047,391 B2 * 11/2011 Lu ..... 220/9.4
2005/0074187 A1 * 4/2005 Sabounjian ..... 383/38
2006/0011628 A1 * 1/2006 Guevara ..... 220/9.1

* cited by examiner

*Primary Examiner* — David Fidei
(74) *Attorney, Agent, or Firm* — Alan Kamrath; Kamrath IP Lawfirm, PA

(57) ABSTRACT

A storage box includes a support assembly having a plurality of supports, connectors, and lower posts. The support assembly is placed to support an outer part member, and the outer part member includes outer and inner sheets covering a bottom end thereof to wrap the bottom supports of the support assembly and casing a flat body. The inner sheet includes a jointing medium defined thereon. The outer part member further includes a covering section extending from the upper end thereof to cover an opening of the body. A plurality of sub supports are used to expand the covering section flatly so that the covering section covers the opening of the body completely.

9 Claims, 14 Drawing Sheets

STORAGE BOX

BACKGROUND OF THE INVENTION

1. Field of the Invention

The present invention relates to a storage box assembled quickly and easily to obtain a secure protection and light and portable purpose, and when the storage box is not used, it is storable.

2. Description of the Prior Art

A conventional storage box is light and made of hard plastic material with different sizes. The plastic box includes an opening formed on an upper side thereof to match with a plastic cover, storing different sizes of objects based on requirement.

However, when the storage box does not store objects, it will occupy space.

Therefore, a storable plastic box was developed to overcome above-mentioned problem. However, such a storable plastic box is worked through complicate processes by using many molds, and a plurality of components are formed to be assembled together, thus consuming time and cost in producing such a storable plastic box.

The present invention has arisen to mitigate and/or obviate the afore-described disadvantages.

SUMMARY OF THE INVENTION

The primary object of the present invention is to provide a storage box assembled quickly and easily to obtain a secure protection and light and portable purpose, and when the storage box is not used, it is storable.

The second object of the present invention is to provide a storage box that can expand the covering section flatly and cover the opening of the body completely by using the covering section.

The third object of the present invention is to provide a storage box with the outer part member made of hard and waterproof canvas to reinforce strength and prevent the storage box from getting wet.

The fourth object of the present invention is to provide a storage box with the jointing medium being a zipper to zip or unzip the assembled support assembly easily and quickly.

Another object of the present invention is to provide a storage box including a number of rollers secured on a bottom end thereof to be portable easily.

A storage box in accordance with a preferred embodiment of the present invention comprises a support assembly including a plurality of supports, connectors, and lower posts.

The support assembly is placed to support an outer part member, and the outer part member includes outer and inner sheets to wrap bottom supports of the support assembly and casing a flat body, with the inner sheet including a jointing medium defined thereon.

The outer part member further includes a covering section extending from the upper end thereof to cover an opening of the body. A plurality of sub supports are used to expand the covering section flatly so that the covering section covers the opening of the body completely.

DETAILED DESCRIPTION OF THE PREFERRED EMBODIMENTS

The present invention will be clearer from the following description when viewed together with the accompanying drawings, which show, for purpose of illustration only, the preferred embodiments in accordance with the present invention.

Figure 1:
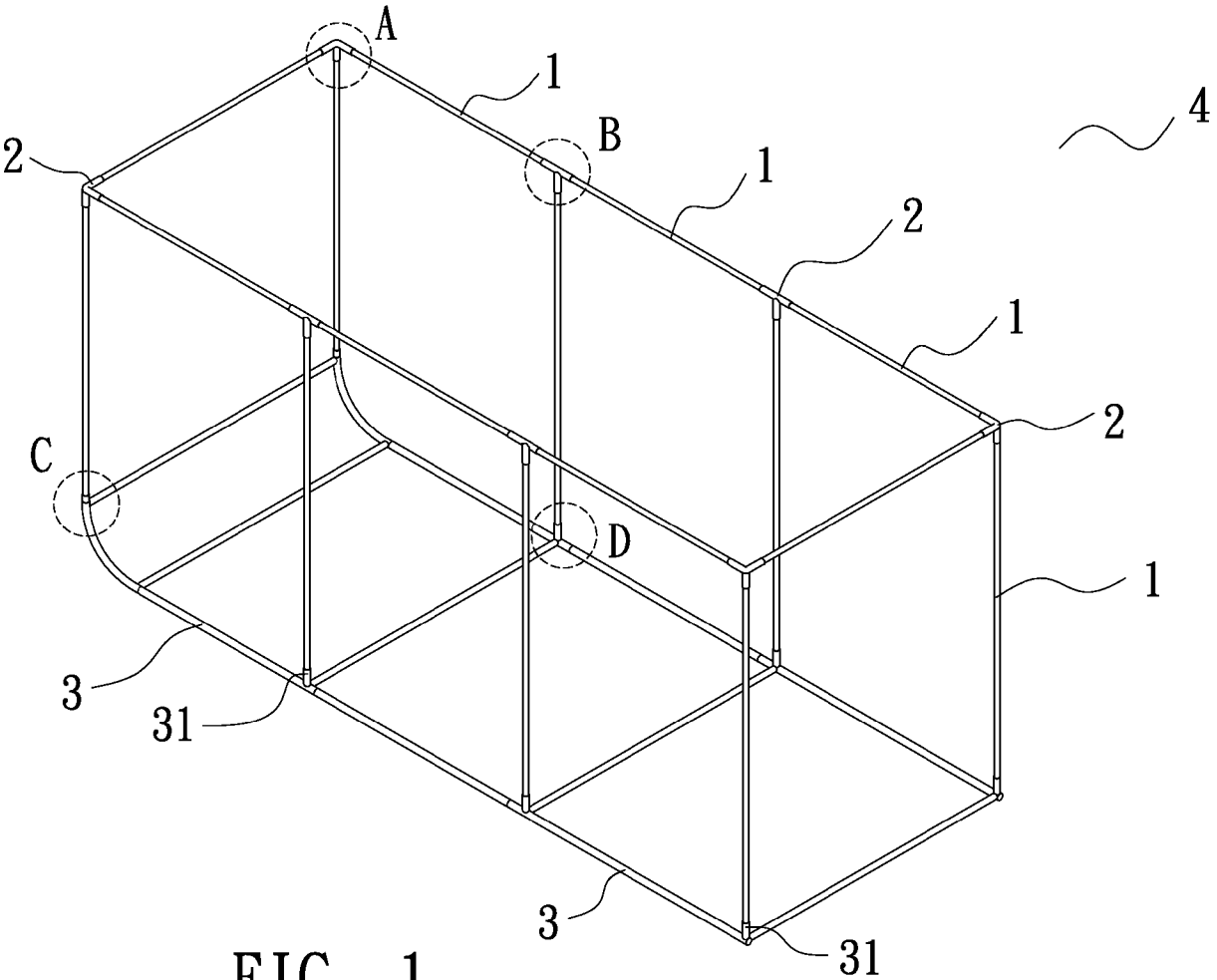
FIG. 1 is a perspective view showing the assembly of a support assembly of a storage box according to a preferred embodiment of the present invention.
Figure 2:
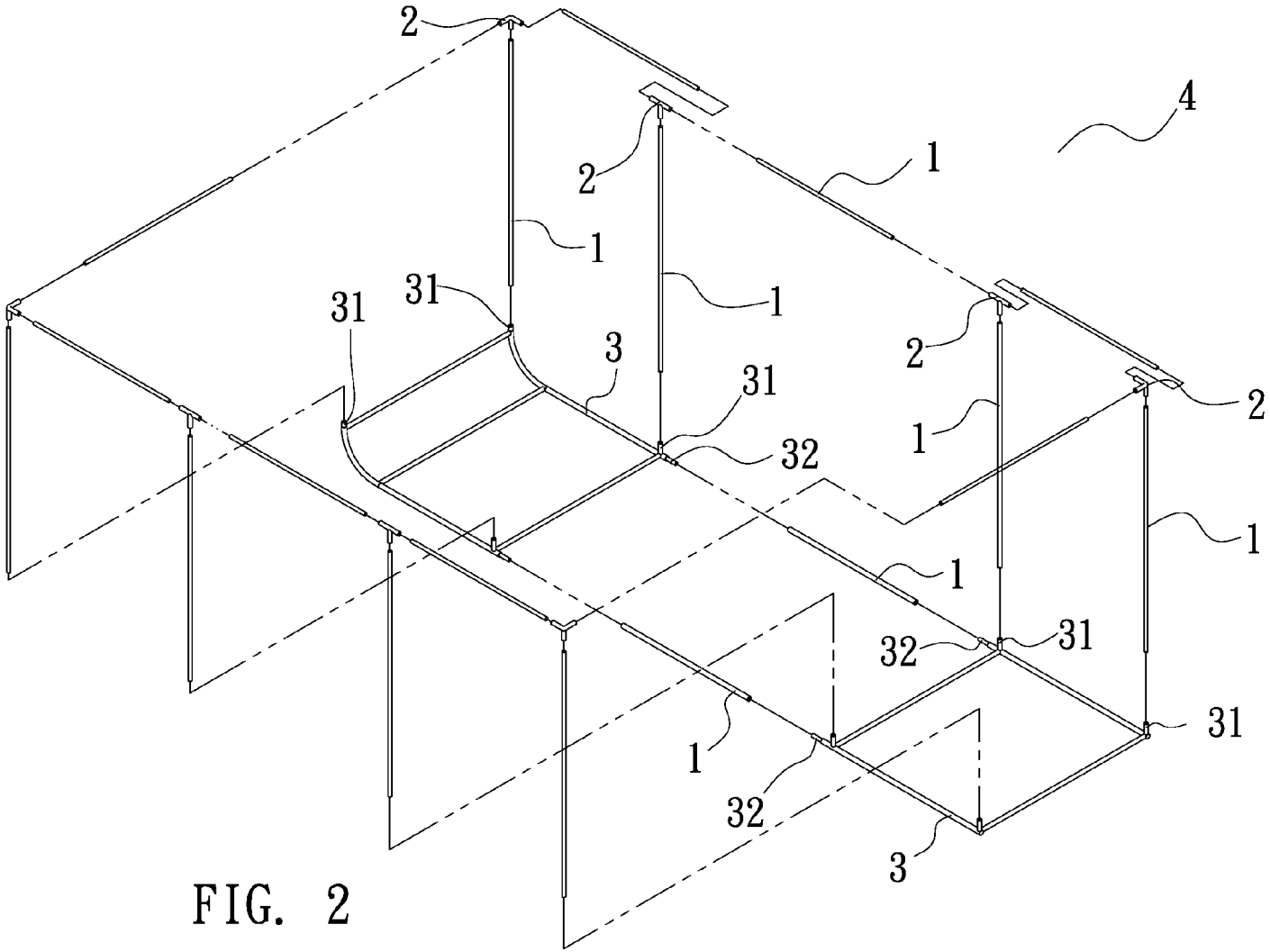
FIG. 2 is a perspective view showing the exploded components of the support assembly of the storage box according to the preferred embodiment of the present invention.
Figure 3:
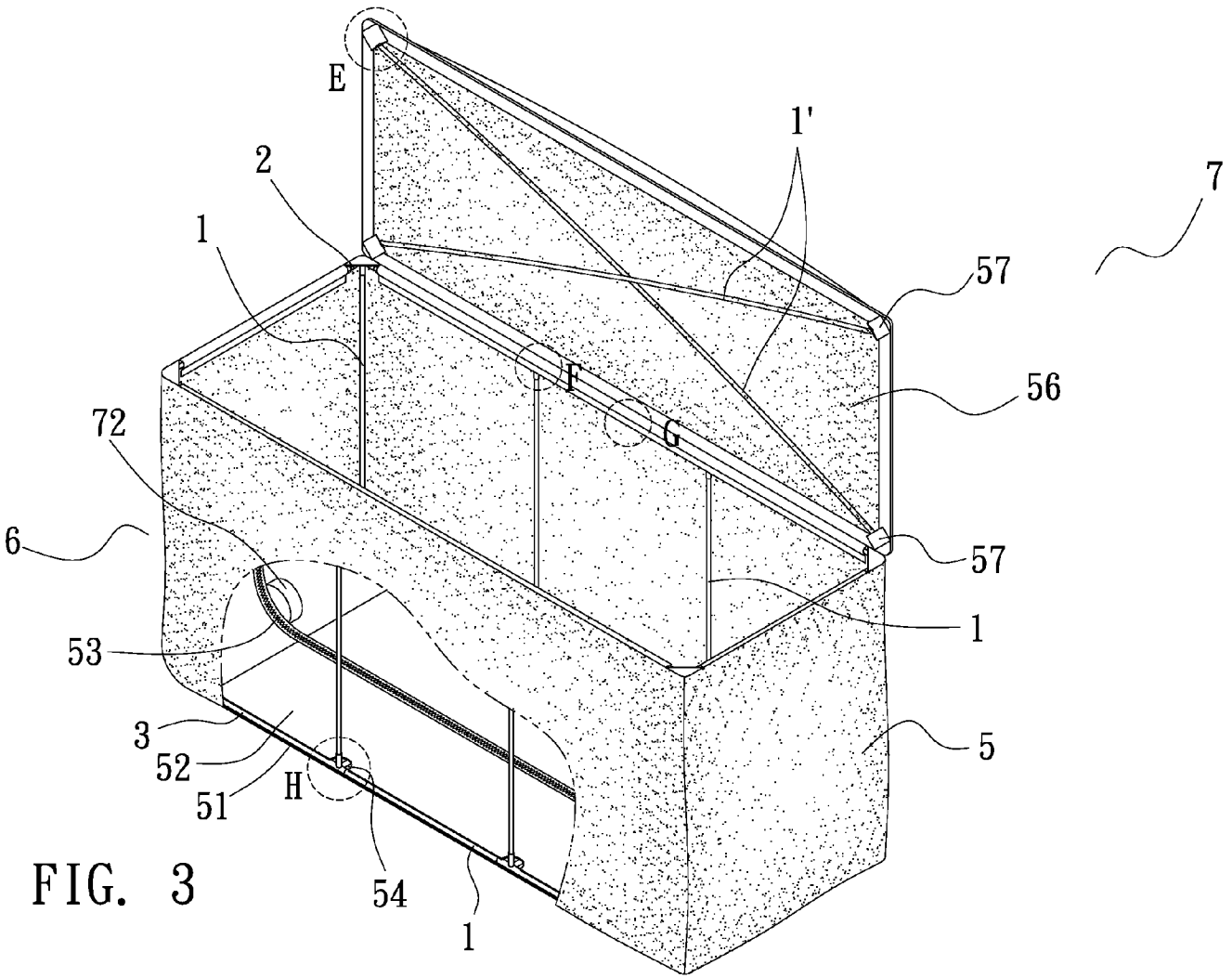
FIG. 3 is a perspective view showing the assembly of the storage box according to the preferred embodiment of the present invention.

A storage box 7 (as shown in FIGS. 1 and 3) according to a preferred embodiment of the present invention includes a support assembly 4 and a hollow outer part member 5. The support assembly 4 (as illustrated in FIG. 2) includes a plurality of supports 1, connectors 2, and lower posts 3.

Figure 8A:
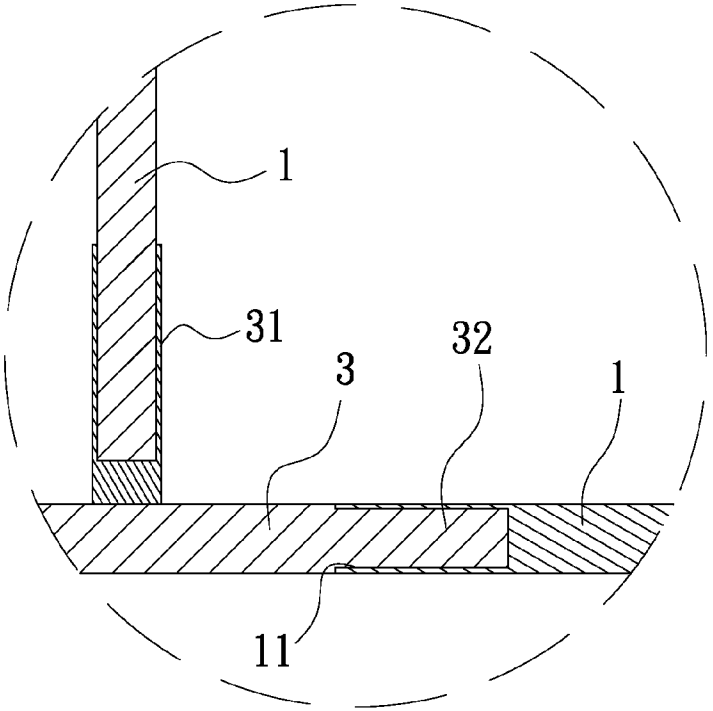
FIG. 8A is a cross sectional view of FIG. 8.

The support 1 arranged horizontally on a lower side of the storage box 7 includes a hollow first stem section with a predetermined length, and the hollow first stem section includes first internal connecting portions 11 formed on two sides thereof respectively (as shown in FIG. 8A). The support 1 arranged horizontally on an upper side of the storage box 7 includes a hollow second stein section with a predetermined length.

Figure 5A:
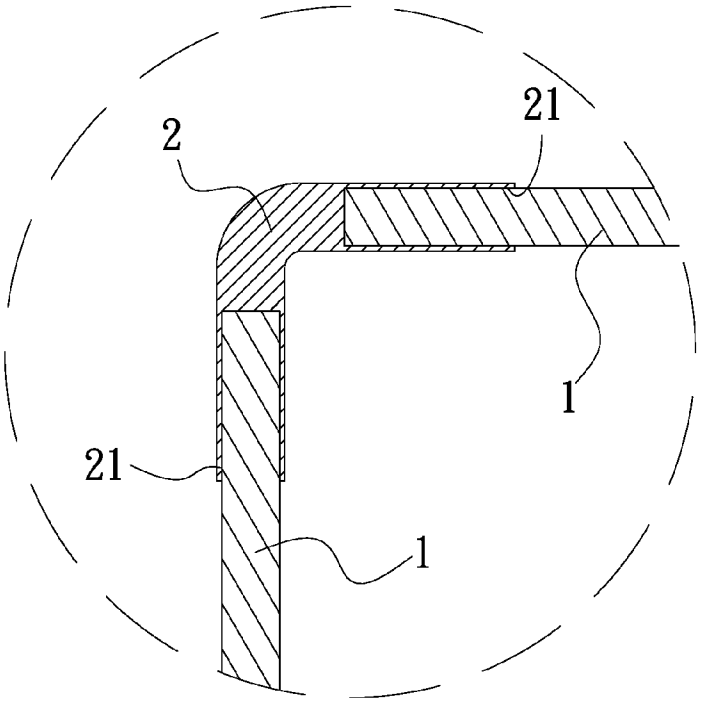
FIG. 5A is a cross sectional view of FIG. 5.
Figure 5:
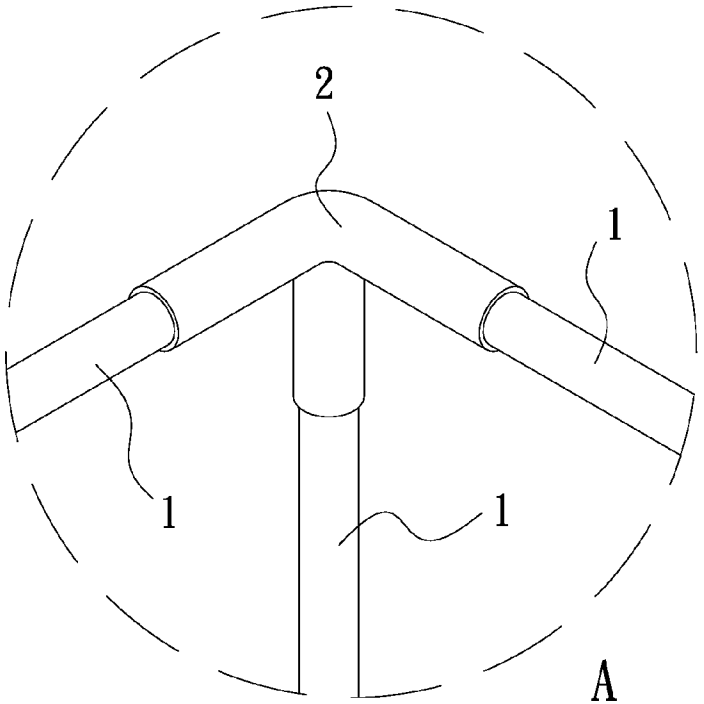
FIG. 5 is a perspective view of a part A of FIG. 1.
Figure 6A:
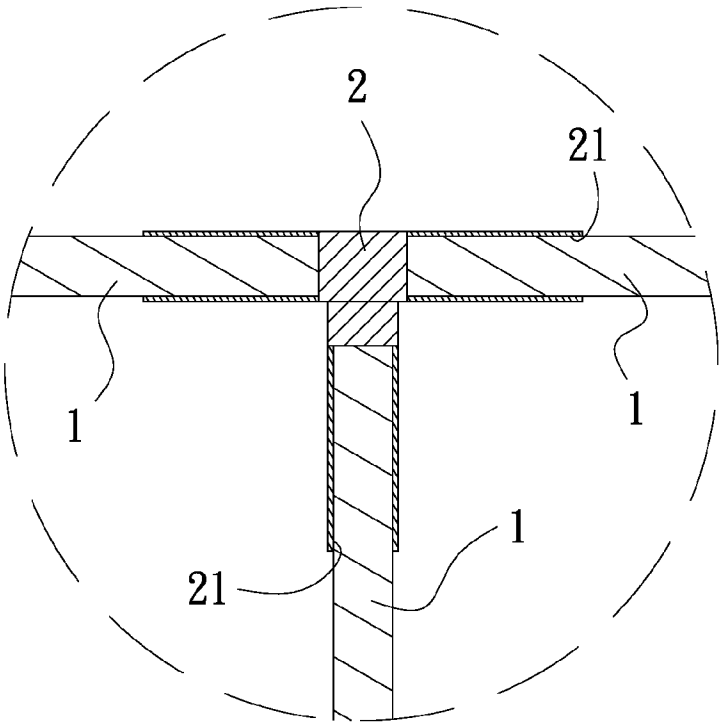
FIG. 6A is a cross sectional view of FIG. 6.
Figure 6:
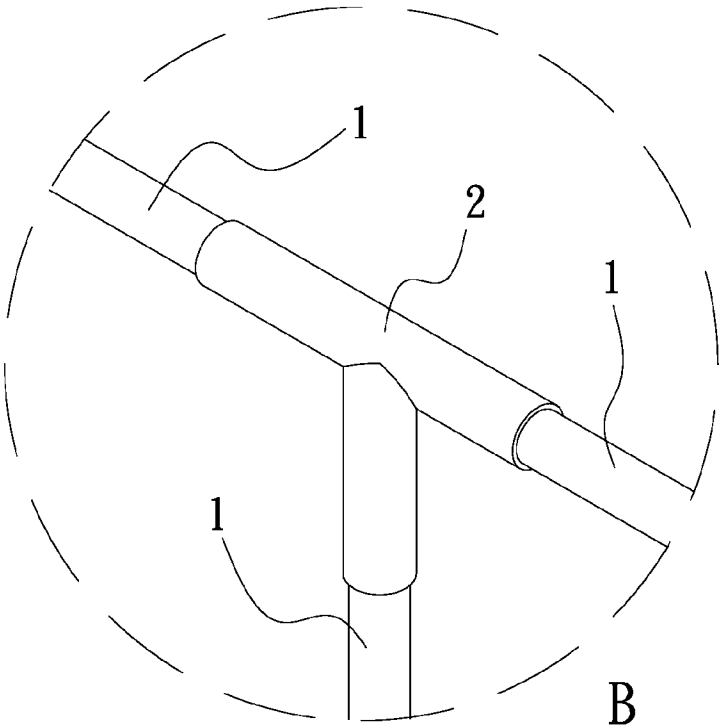
FIG. 6 is a perspective view of a part B of FIG. 1.

The connectors 2 are coupling tube sections to be connected with the supports 1 by using a tee or a cornered extending element. Therefore, the connector 2 includes a second internal connecting portion 21 extending from the extending element thereof (as illustrated in FIGS. 5A and 6A) to couple with the supports 1.

Figure 7A:
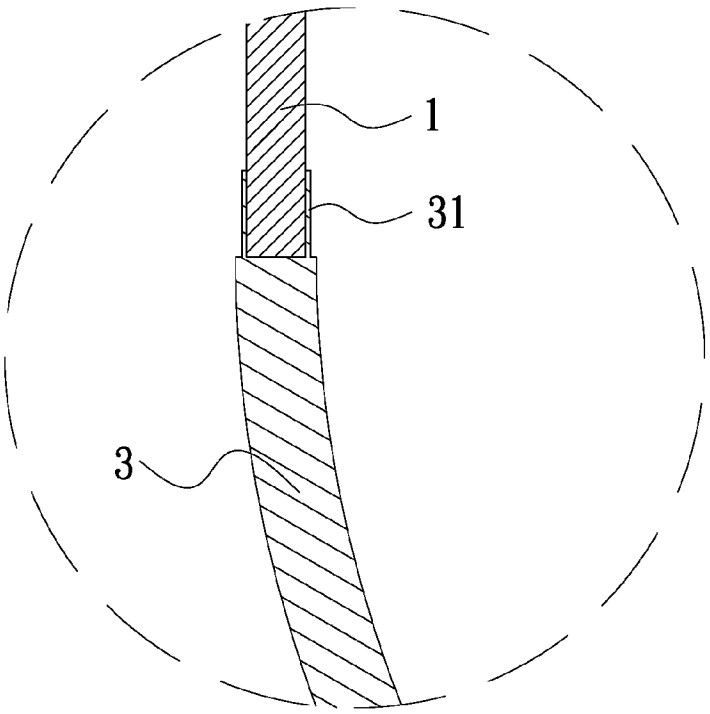
FIG. 7A is a cross sectional view of FIG. 7.
Figure 7:
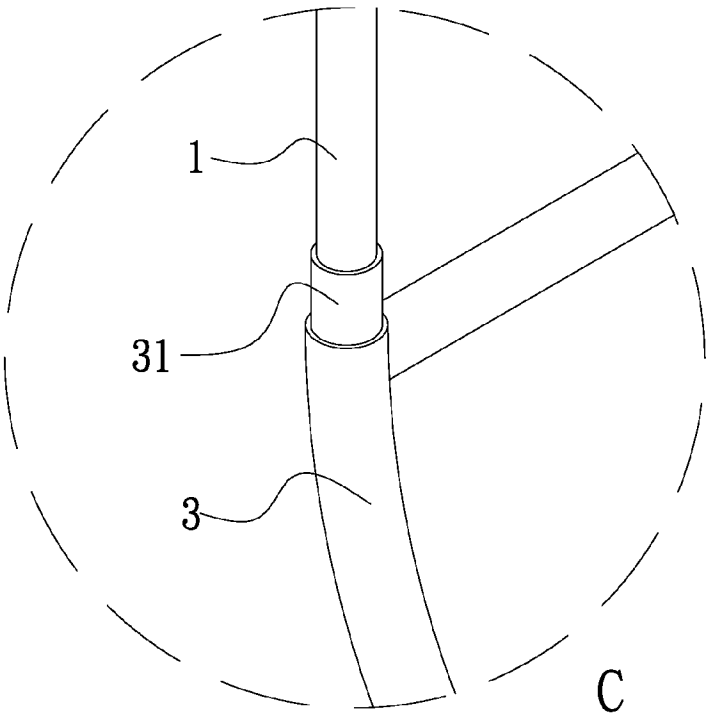
FIG. 7 is a perspective view of a part C of FIG. 1.

The lower posts 3 are integrally formed and arranged to form a frame with a predetermined width. The lower posts 3 includes a coupling hose section 31 extending upward from a corner thereof (as shown in FIGS. 7A and 8A) to connect with the supports 1. The lower posts 3 further includes a coupling rod section 32 with a smaller outer diameter extending outward from one side thereof (as illustrated in FIG. 8A) to be fitted to the first internal connecting portion 11 of the support 1.

Figure 8:
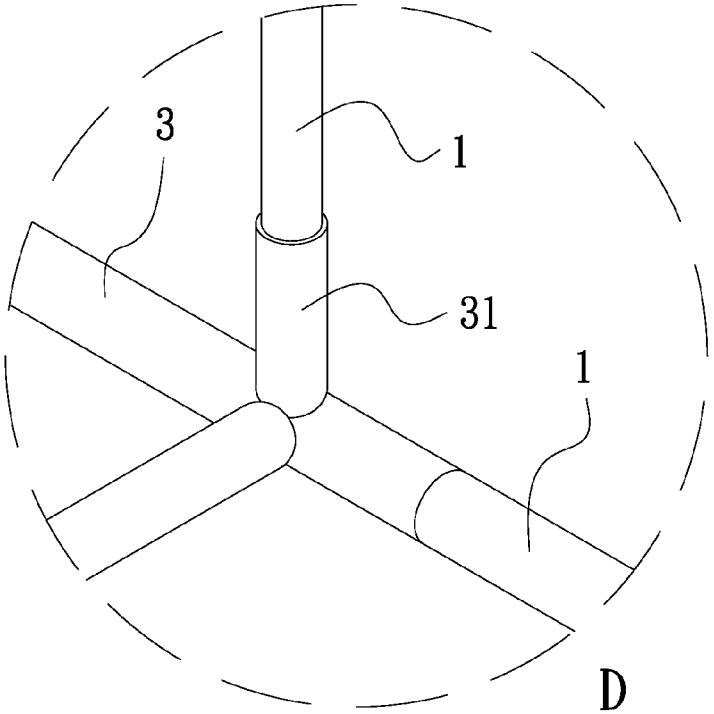
FIG. 8 is a perspective view of a part D of FIG. 1.

In assembly (as shown in FIGS. 1 and 2), the first internal connecting portions 11 of the two sides of the lower support 1 are fitted to the coupling rod section 32 of the lower post 3 (as illustrated in FIGS. 8 and 8A). Thereafter, the vertical support 1 is fitted to the coupling hose section 31 of the lower post 3 (as shown in FIGS. 7, 7A, 8, 8A). Then, an upper end of the vertical support 1 is fitted and then coupled to the second internal connecting portion 21 of the connector 2 by using the tee or the cornered extending element (as illustrated in FIGS. 5, 5A, 6, and 6A), thereby assembling the support assembly 4.

Figure 4:
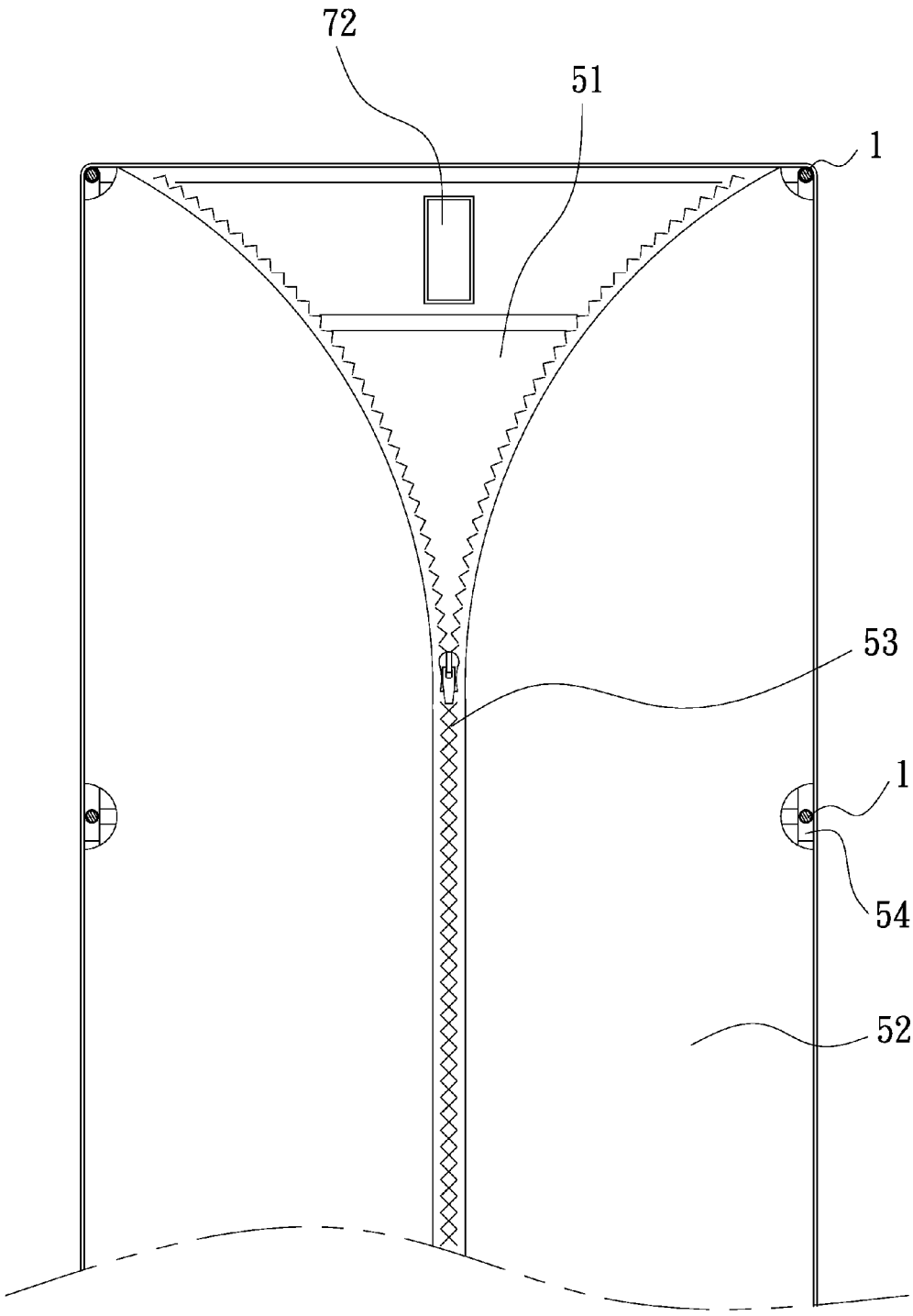
FIG. 4 is a plan view showing the assembly of an outer part member of the storage box according to the preferred embodiment of the present invention.
Figure 9A:
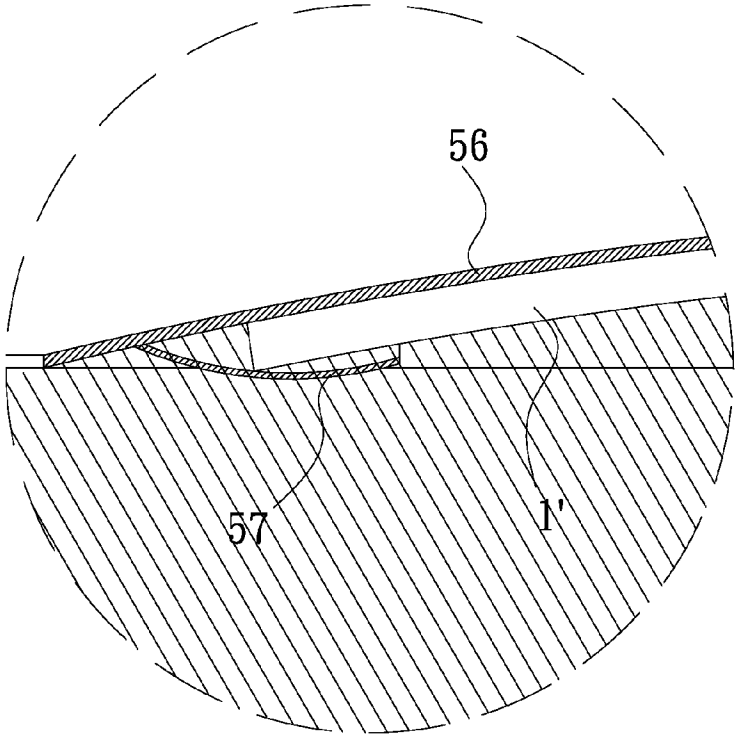
FIG. 9A is a cross sectional view of FIG. 9.
Figure 9:
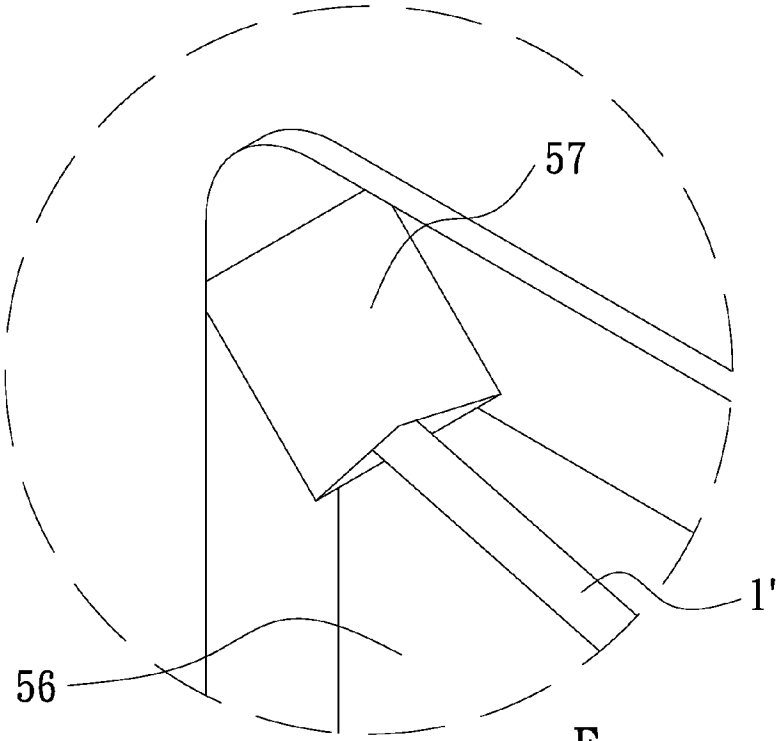
FIG. 9 is a perspective view of a part E of FIG. 3.
Figure 11:
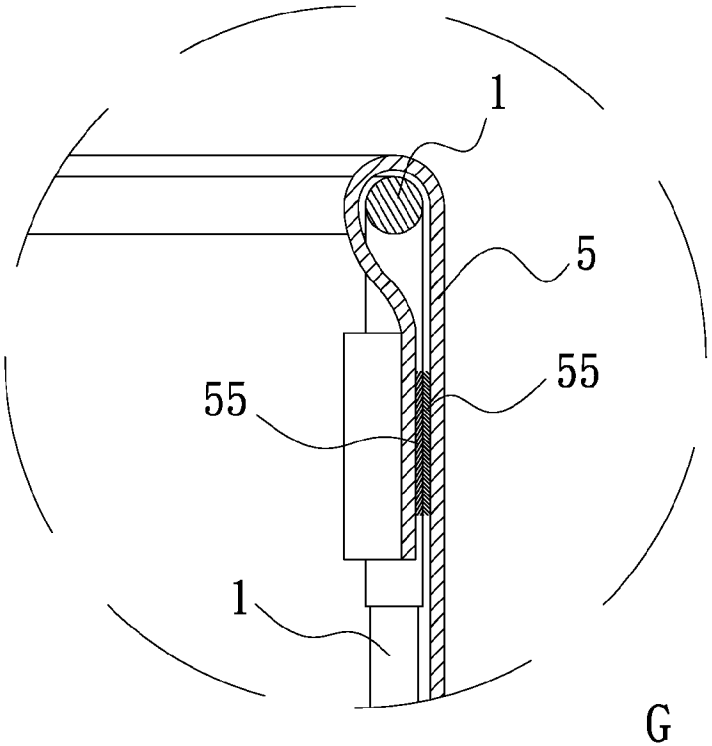
FIG. 11 is a cross sectional view of a part G of FIG. 3.
Figure 10:
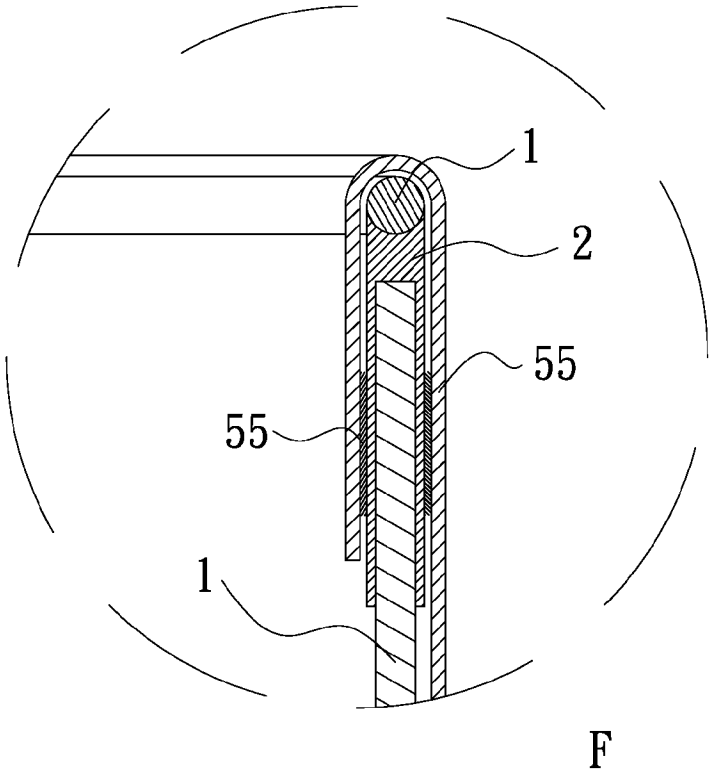
FIG. 10 is a cross sectional view of a part F of FIG. 3.
Figure 12A:
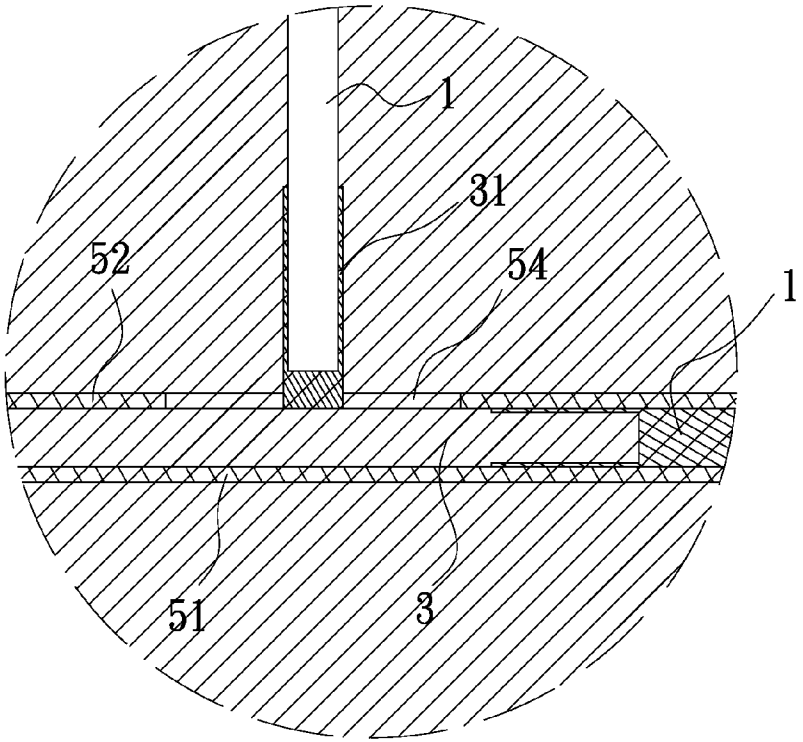
FIG. 12A is a cross sectional view of FIG. 12.
Figure 12:
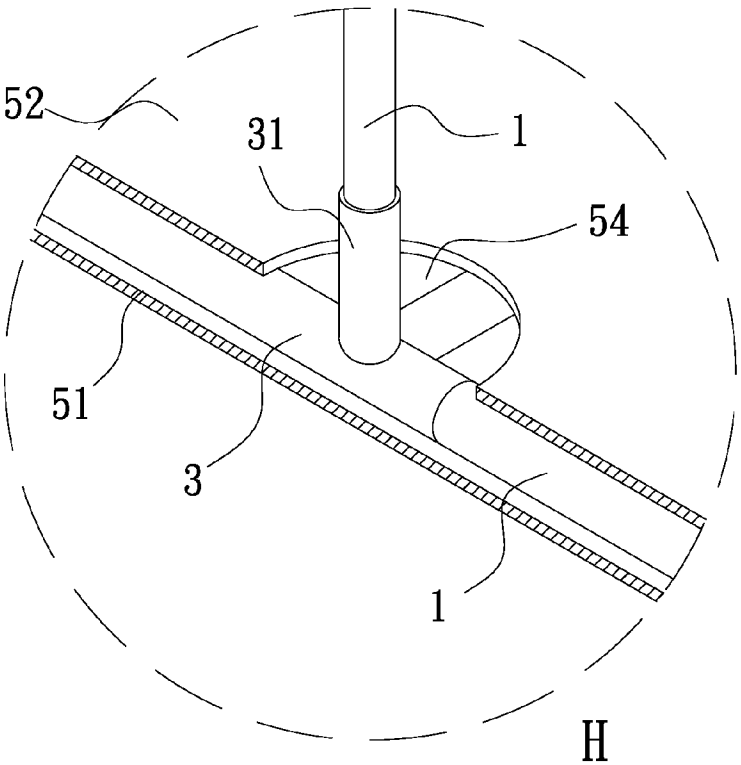
FIG. 12 is a perspective view of a part H of FIG. 3.
Figure 13:
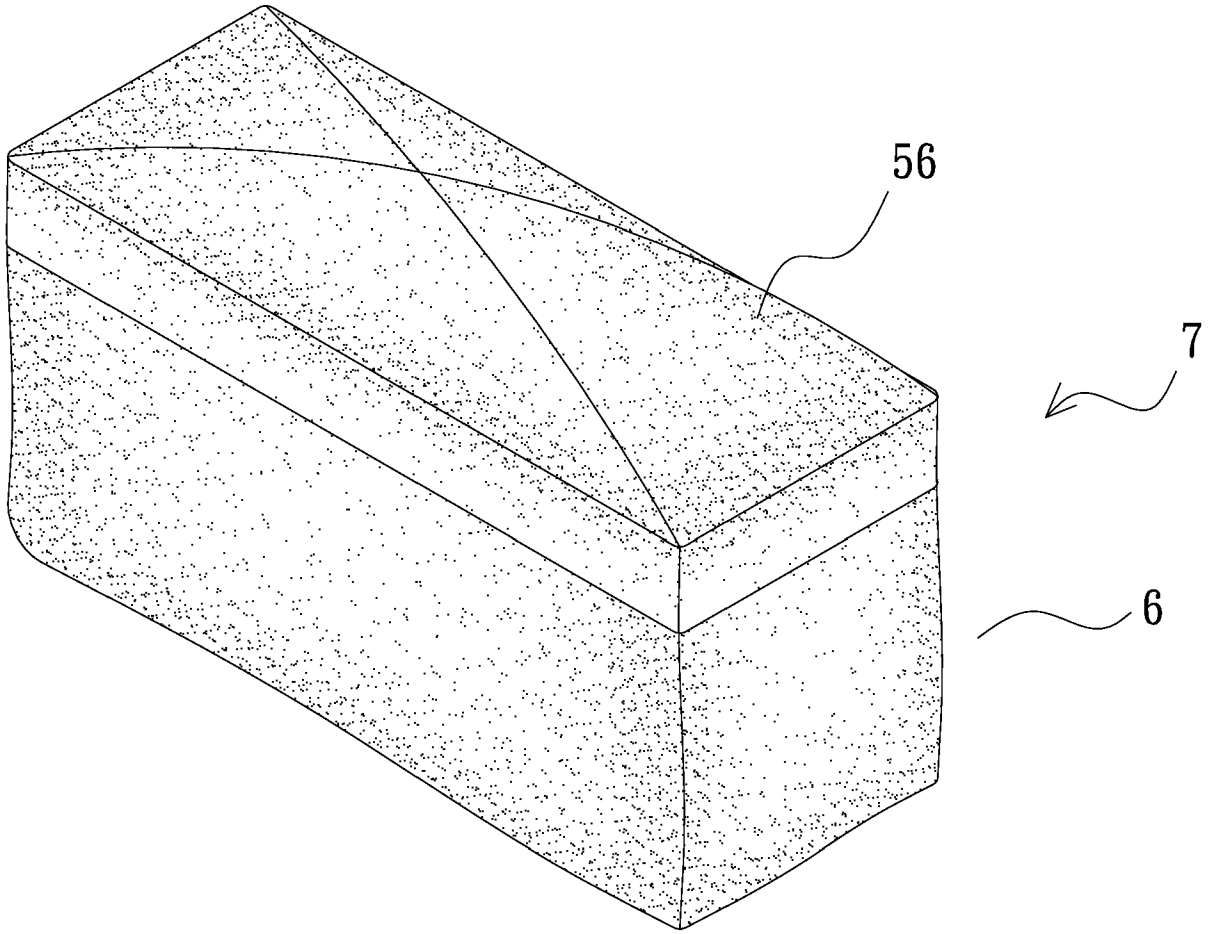
FIG. 13 is a perspective view showing a covering section covering to an opening of the storage box.
Figure 14:
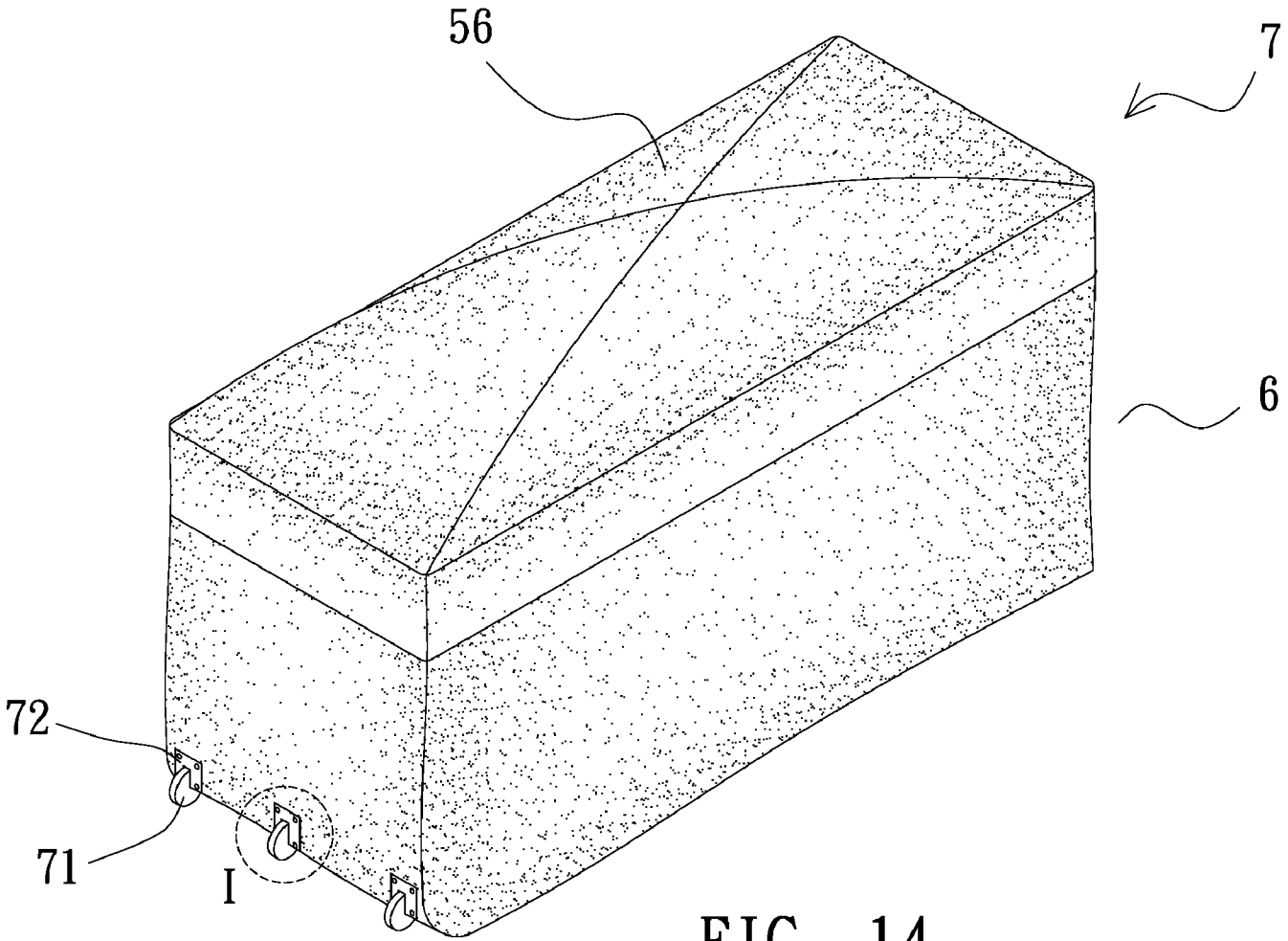
FIG. 14 is another perspective view showing the covering section covering the opening of the storage box.
Figure 15A:
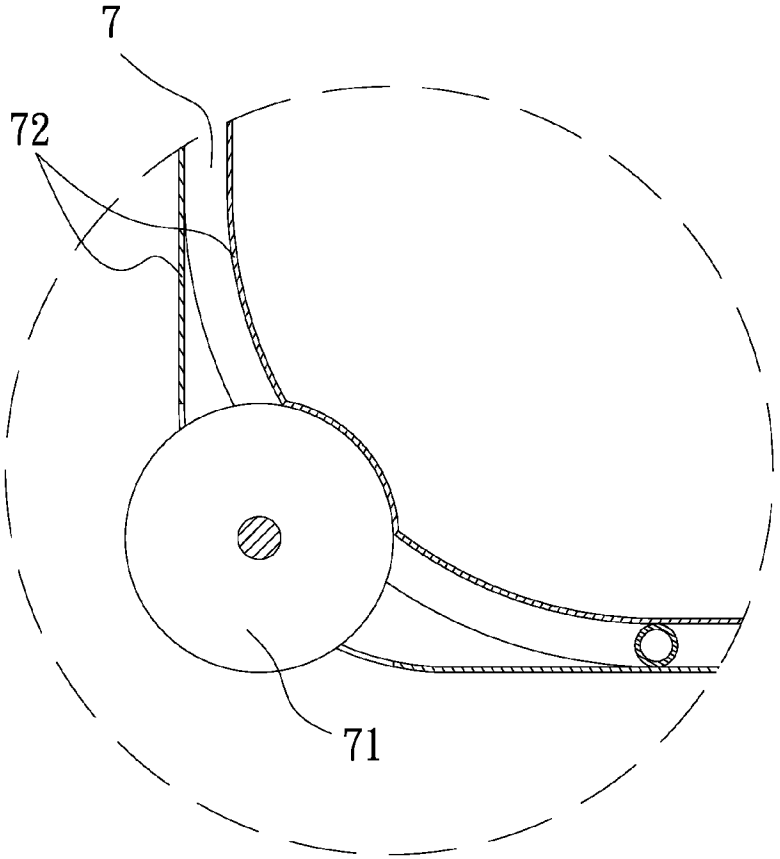
FIG. 15A is a cross sectional view of FIG. 15.
Figure 15:
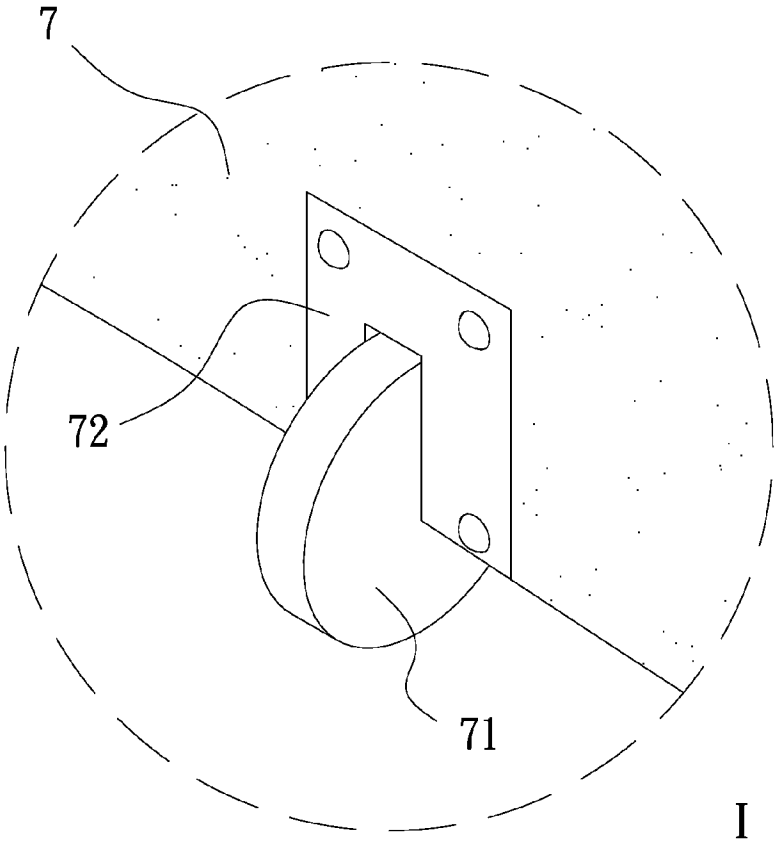
FIG. 15 is a perspective view of a part I of FIG. 14.

The assembled support assembly 4 is placed to support the outer part member 5. In this embodiment, the outer part member 5 is made of hard and waterproof canvas as shown in FIG. 3. The outer post member 5 includes outer and inner sheets 51, 52 covering a bottom end thereof to wrap bottom supports 1 of the assembled support assembly 4 and casing a flat body 6. The inner sheet 52 includes a jointing medium 53 defined thereon. In this embodiment, the jointing medium 53 is a zipper to zip or unzip the assembled support assembly 4 easily and quickly as illustrated in FIG. 4. Between the inner sheet 52 and the vertical support 1 is defined a cutout 54 (as shown in FIGS. 12 and 12A) to integrally connect the outer and inner sheets 51, 52 of the outer part member 5 together easily. The outer part member 5 also includes two hook and loop fasteners 55 fixed adjacent to an upper end of an inner wall thereof (as illustrated in FIGS. 10, 11). Thus, after the outer part member 5 is passed through a peripheral side of an upper end of the assembled support assembly 4, the hook and loop fasteners 55 retain together. The outer part member 5 further includes a covering section 56 extending from the upper end thereof to cover an opening of the body 6. The covering section 56 includes four receiving rooms 57 formed on four corners thereof individually (as illustrated in FIGS. 9 and 9A). Thus, at least two sub supports 1' are fitted to the receiving room 57 crossingly to expand the covering section 56 flatly so that the covering section 56 covers the opening of the body 6 completely (as shown in FIG. 13). In addition, the storage box 7 includes a number of rollers 71 secured on a bottom end thereof (as shown in FIG. 14). The storage box 7 further includes a plurality of retaining pieces 72 disposed on the bottom end thereof by arcuate metal racks to retain the rollers 71 (as illustrated in FIGS. 15, 15A), thus moving the storage box 7 easily.

Thereby, the storage box 7 is assembled quickly and easily to obtain a secure protection, and when the storage box 7 is not used, it is storable.

The support assembly 4 includes a plurality of supports 1, connectors 2, lower posts 3, and sub supports 1', all of which are made of hollow metal shafts, to achieve a light and portable purpose.

While various embodiments in accordance with the present invention have been shown and described, it is clear to those skilled in the art that further embodiments may be made without departing from the scope of the present invention.

What is claimed is:

1. A storage box comprising:

a support assembly including a lower frame, an upper frame defining an opening and a plurality of vertical supports extending between the lower and upper frames;

outer and inner sheets wrapping the lower frame of the support assembly and casing a flat body, wherein the inner sheet includes a jointing medium defined thereon, with the lower frame located intermediate the outer and inner sheets, with the lower frame including first and second lower posts having first, vertical ends and second, horizontal ends, with the first and second lower posts having an arcuate shape between the first and vertical ends and the second, horizontal ends, with first and second vertical supports of the plurality of vertical supports being connected to the first, vertical ends of the first and second lower posts;

an outer part member including a wall section extending between the lower and upper frames and extending over the plurality of vertical supports, wherein the outer part member further includes a covering section extending from an upper end of the wall section to cover the opening of the upper frame, wherein the covering section includes four receiving rooms formed on four corners thereof individually; and first and second sub supports each having first and second ends each located in one of the receiving rooms, with the first and second sub supports each being in the form of a rod, with the first and second sub supports crossing to form an X to expand the covering section flatly.

2. The storage box as claimed in claim 1, wherein the first, vertical ends and the second, horizontal ends each includes a hollow connecting portion, with the first and second vertical supports slideably received in the hollow connection portions of the first and second lower posts;

wherein the upper frame includes first, second and third horizontal supports;

wherein the storage box further comprises first and second connectors having first, second and third coupling tube sections connected with a cornered extending element, with the first horizontal support having first and second ends slideably received in the first coupling tube sections of the first and second connectors, with the first and second vertical supports slideably received in the second coupling tube sections of the first and second connectors, and with first ends of the second and third horizontal supports slideably received in the third coupling tube sections of the first and second connectors;

third and fourth connectors having first and second coupling tube sections, with second ends of the second and third horizontal supports slideably received in the first coupling tube sections of the third and fourth connectors, with the plurality of vertical supports including third and fourth vertical supports each having upper and lower ends, with the upper ends of the third and fourth vertical supports slideably received in the second coupling tube sections of the third and fourth connections; and fifth and sixth connectors each including a first coupling tube section slideably receiving the lower end of one of the third and fourth vertical supports, with the fifth and sixth connectors each including an internal connecting portion slideably received in the hollow connecting portion of the second horizontal end of one of the first and second lower posts.

3. The storage box as claimed in claim 2, wherein the plurality of vertical supports, the connectors, the lower posts, and the sub supports are made of hollow metal shafts.

4. The storage box as claimed in claim 1, wherein the plurality of vertical supports, the connectors, the lower posts, and the sub supports are made of hollow metal shafts.

5. The storage box as claimed in claim 1, wherein the outer part member includes two hook and loop fasteners fixed adjacent to an upper end of an inner wall thereof so that after the outer part member is passed through the upper frame, the hook and loop fasteners retain together.

6. The storage box as claimed in claim 1, wherein the outer part member is made of hard and waterproof canvas.

7. The storage box as claimed in claim 1, wherein the jointing medium is a zipper to zip or unzip the inner sheet easily and quickly.

8. The storage box as claimed in claim 1, wherein between the inner sheet and one of the plurality of vertical supports is defined a cutout to integrally connect the outer and inner sheets together easily.

9. The storage box as claimed in claim 1, further comprising a plurality of rollers secured on the lower frame, and a plurality of retaining pieces disposed by arcuate metal racks to retain the plurality of rollers adjacent to the arcuate shape, thus moving the storage box easily.

* * * * *